US007047649B2

(12) United States Patent
Pleshek

(10) Patent No.: US 7,047,649 B2
(45) Date of Patent: May 23, 2006

(54) POWER CORD FOR A HAND-HELD ELECTRICAL DEVICE

(75) Inventor: Mark A. Pleshek, Milwaukee, WI (US)

(73) Assignee: Andis Company, Sturtevant, WI (US)

( * ) Notice: Subject to any disclaimer, the term of this patent is extended or adjusted under 35 U.S.C. 154(b) by 136 days.

(21) Appl. No.: 10/429,498

(22) Filed: May 5, 2003

(65) Prior Publication Data

US 2004/0221458 A1 Nov. 11, 2004

(51) Int. Cl.
*B26B 19/02* (2006.01)

(52) U.S. Cl. ..... 30/210; 30/208; 439/668; 439/669

(58) Field of Classification Search ..... 30/210, 30/43.92, 228, 513, 208, 105, 209, 211; 439/133, 439/134, 668, 669, 488, 490, 622, 621, 529, 439/524, 455, 105, 208–211, 527; 379/446, 379/445, 454; 324/133; 339/10, 32
See application file for complete search history.

(56) References Cited

U.S. PATENT DOCUMENTS 1,927,293 A * 9/1933 Pearson et al. ..... 439/739
1,956,042 A 4/1934 Oster
2,221,280 A * 11/1940 Woodside ..... 200/51.07
2,539,352 A * 1/1951 Hewlett ..... 323/354
2,703,930 A 3/1955 Bridenbaugh
3,079,687 A * 3/1963 Jepson ..... 30/210
4,632,121 A * 12/1986 Johnson et al. ..... 600/372
4,824,402 A * 4/1989 Sorimachi ..... 439/680
5,066,249 A * 11/1991 Doye et al. ..... 439/585
5,135,406 A * 8/1992 Ishikawa ..... 439/131
5,268,629 A * 12/1993 Franke ..... 320/114
5,376,022 A * 12/1994 Carr et al. ..... 439/668
5,687,234 A * 11/1997 Chang ..... 379/454
5,775,952 A * 7/1998 Lu ..... 439/668
5,839,919 A * 11/1998 Chen ..... 439/529
6,007,373 A * 12/1999 Chew ..... 439/504
6,080,021 A * 6/2000 Weingartner ..... 439/669
6,126,465 A * 10/2000 Franks, Jr. ..... 439/218
6,231,396 B1 * 5/2001 Huang ..... 439/668
6,322,397 B1 * 11/2001 Zhang ..... 439/668
6,461,198 B1 * 10/2002 Chao ..... 439/668
6,461,199 B1 * 10/2002 Koga et al. ..... 439/668

(Continued)

OTHER PUBLICATIONS

Charger and phone sold by Nokia offered for sale at least as early as Apr. 2002 (see attached Statement of Relevance and Fig. 1).

*Primary Examiner*—Allan N. Shoap
*Assistant Examiner*—Ghassem Alie
(74) *Attorney, Agent, or Firm*—Michael Best & Friedrich LLP

(57) ABSTRACT

A hand-held electrical device having a power cord that provides enhanced retainment of the power cord to a receptacle of the hand-held electrical device during operation of the hand-held electrical device. The power cord includes an enlarged tip portion that provides axial resistance against removal of the power cord from the receptacle of the hand-held electrical device when the power cord is operatively coupled to receptacle of the hand-held electrical device. The axial resistance provided by the enlarged tip portion increases the force necessary to remove the power cord from the receptacle of the hand-held electrical device, and thus decreases the likelihood of the power cord being inadvertently detached from the hand-held electrical device during operation of the hand-held electrical device.

17 Claims, 4 Drawing Sheets

U.S. PATENT DOCUMENTS 6,551,142 B1 * 4/2003 Eisenbraun ..... 439/668
2002/0143377 A1 * 10/2002 Wessman et al. ..... 607/116
2003/0054698 A1 * 3/2003 Lin ..... 439/668
2003/0100227 A1 * 5/2003 Yeh ..... 439/668
2003/0119368 A1 * 6/2003 Li et al. ..... 439/668
2003/0207603 A1 * 11/2003 Potega ..... 439/218
2004/0110424 A1 * 6/2004 Lin et al. ..... 439/675
2004/0132344 A1 * 7/2004 Plishner ..... 439/668
2004/0219834 A1 * 11/2004 Vielhaber et al. ..... 439/585

* cited by examiner

POWER CORD FOR A HAND-HELD ELECTRICAL DEVICE

BACKGROUND OF THE INVENTION

The invention relates generally to power cords, and more specifically to power cords for hand-held electrical devices.

Hand-held electrical devices such as hair trimmers typically include a power cord. The power cord may be either permanently or removably coupled to the housing of the hand-held electrical device. Some types of removably coupled power cords have a tendency to detach during operation of the hand-held electrical device. Although a number of arrangements for selectively retaining such power cords are known, a new arrangement that improves the overall usability of the hand-held electrical device would be welcomed by those in the art.

SUMMARY OF THE INVENTION

The invention provides a power cord that provides enhanced retainment of the power cord in a hand-held electrical device during operation of the hand-held electrical device. The power cord includes an enlarged tip portion that provides axial resistance against removal of the power cord from a housing of the hand-held electrical device when the power cord is operatively coupled to the housing of the hand-held electrical device.

In one embodiment, the invention provides a hand-held electrical device having a housing configured to be hand-held during operation of the hand-held electrical device and defining an aperture. An electrical component is positioned in the housing. A receptacle is electrically coupled to the electrical component and has a body portion, a male terminal, and a detent terminal. The body portion includes a first end portion located adjacent the aperture, a second end portion, and a recess portion extending from the first end portion towards the second end portion. The male terminal has a male terminal portion located in the recess and extending in a direction from the second end portion toward the first end portion. The detent terminal has a detent terminal portion located in the recess. A power cord having a cord portion and a plug portion is configured to provide direct current voltage to the electrical component when the power cord is operatively received in the receptacle. The cord portion includes first and second electrical conduits. The plug portion includes a generally cylindrical outer terminal electrically coupled to the first electrical conduit and defining a first diameter, a female terminal electrically coupled to the second electrical conduit and located radially inward of the outer terminal, and an insulator portion that electrically insulates the outer terminal from the female terminal and includes a tip portion that extends axially beyond the outer terminal in a direction away from the cord portion and defines a second diameter that is larger than the first diameter.

In another embodiment, the invention provides a hand-held electrical device having a housing configured to be hand-held during operation of the hand-held electrical device and defining an aperture. A direct current motor positioned in the housing. A receptacle is electrically coupled to the direct current motor and has a body portion, a male terminal, and a detent terminal. The body portion includes a first end portion located adjacent the aperture, a second end portion, and a recess portion extending from the first end portion towards the second end portion and having a generally cylindrical portion defining a receptacle diameter and a detent portion intersecting the generally cylindrical portion. The male terminal has a male terminal portion substantially centered in the generally cylindrical portion and extending in a direction from the second end portion toward the first end portion. The detent terminal has a detent terminal portion located in the detent portion. A power cord having a cord portion and a plug portion is configured to provide direct current voltage to the direct current motor when a portion of the power cord is inserted through the aperture to operatively couple the power cord to the receptacle. The cord portion includes first and second electrical conduits. The plug portion includes a generally cylindrical outer terminal electrically coupled to the first electrical conduit and defining an outer terminal diameter, a female terminal electrically coupled to the second electrical conduit and located radially inward of the outer terminal, and an insulator portion formed of nylon that electrically insulates the outer terminal from the female terminal and includes a generally cylindrical tip portion that extends axially beyond the outer terminal in a direction away from the cord portion and defines a tip portion diameter that is larger than the outer terminal diameter and substantially equal to the receptacle diameter so the tip portion provides axial resistance against the removal of the power cord from the receptacle when the power cord is operatively coupled to the receptacle.

In yet another embodiment, the invention provides a hair trimmer having a housing configured to be hand-held during operation of the hair trimmer and having a cutting end and a plug end and defining an aperture in the plug end. A blade set is mounted adjacent the cutting end. A direct current motor is positioned in the housing and is drivingly connected to the blade set. A receptacle is electrically coupled to the direct current motor and has a body portion, a male terminal, and a detent terminal. The body portion includes a first end portion located adjacent the aperture, a second end portion, and a recess portion extending from the first end portion towards the second end portion and having a generally cylindrical portion defining a receptacle diameter and a detent portion intersecting the generally cylindrical portion. The male terminal has a portion substantially centered in the generally cylindrical portion and extending in a direction from the second end portion toward the first end portion. The detent terminal has a portion located in the detent portion. A power cord having a cord portion and a plug portion is configured to provide direct current voltage to the direct current motor when a portion of the power cord is inserted through the aperture to operatively couple the power cord to the receptacle. The cord portion includes first and second electrical conduits. The plug portion includes a generally cylindrical outer terminal electrically coupled to the first electrical conduit and defining an outer terminal diameter, a female terminal electrically coupled to the second electrical conduit and located radially inward of the outer terminal, and an insulator portion formed of nylon that electrically insulates the outer terminal from the female terminal and includes a generally cylindrical tip portion that extends axially beyond the outer terminal in a direction away from the cord portion and defines a tip portion diameter that is larger than the outer terminal diameter and substantially equal to the receptacle diameter so the tip portion provides axial resistance against the removal of the power cord from the receptacle when the power cord is operatively coupled to the receptacle.

Further objects of the present invention together with the organization and manner of operation thereof, will become apparent from the following detailed description of the invention when taken in conjunction with the accompanying drawings wherein like elements have like numerals throughout the drawings.

BRIEF DESCRIPTION OF THE DRAWINGS

The present invention is further described with reference to the accompanying drawings, which show an embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. Also, it is understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," and "coupled" are used broadly and encompass both direct and indirect mountings, connections, and couplings. Further, "connected" and "coupled" are not restricted to physical or mechanical connections or couplings.

DETAILED DESCRIPTION OF THE PREFERED EMBODIMENT

FIGS. 1 and 3–6 illustrate a power cord 10 embodying the invention. The power cord 10 supplies a direct current voltage to a hand-held electrical device 14 (i.e., an electrical device designed to be supported by an operator, and not normally supported on a surface, during operation). The hand-held electrical device 14 is illustrated as a hair trimmer or clipper 14. It should be understood that the present invention is capable of use on other hand-held electrical devices and the hair trimmer 14 is merely shown and described as an example of one such hand-held electrical device.

Figure 1:
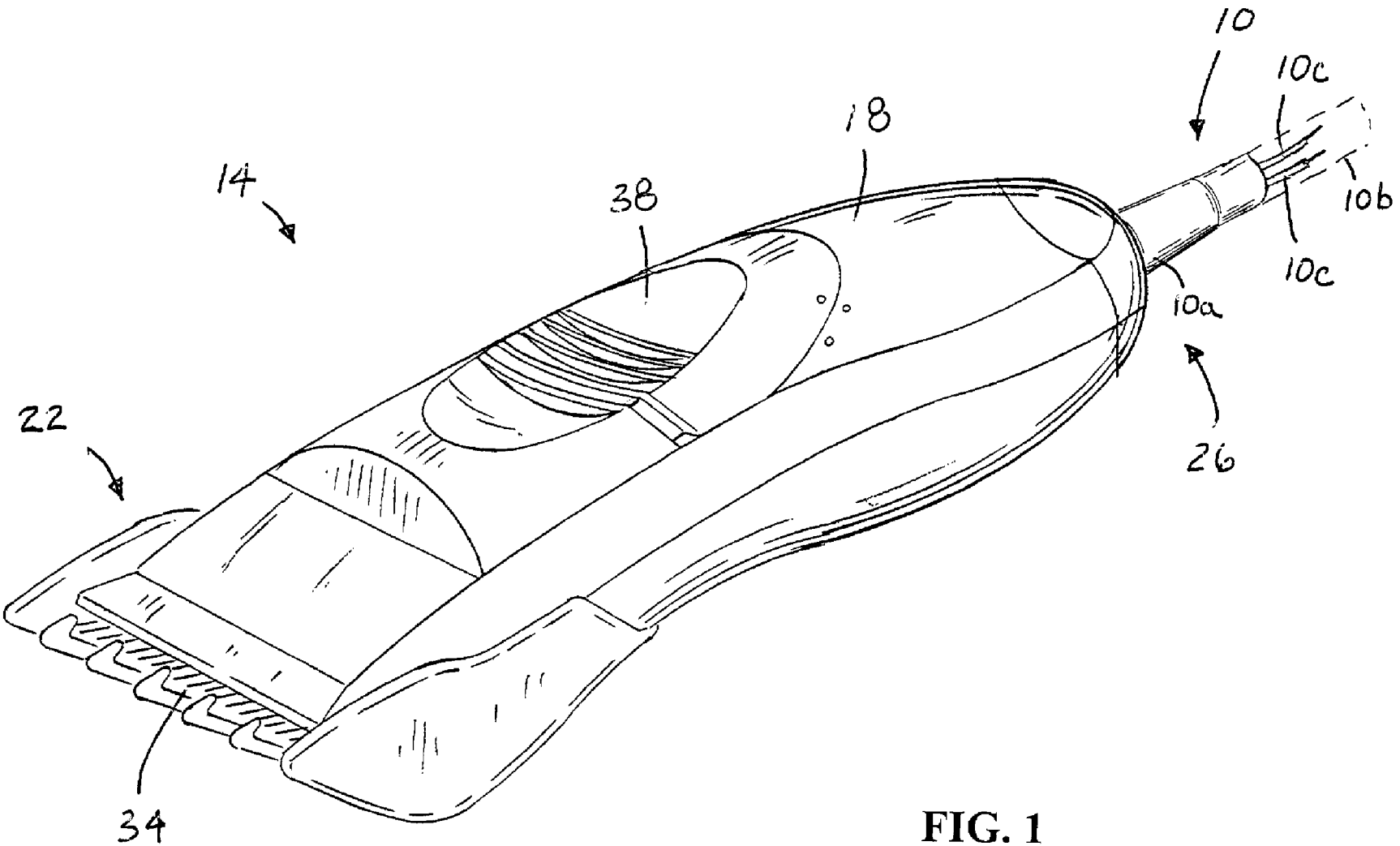
FIG. 1 is a perspective view of a hand-held electrical device embodying various features of the invention and including a power cord coupled to a housing of the electrical device.
Figure 2:
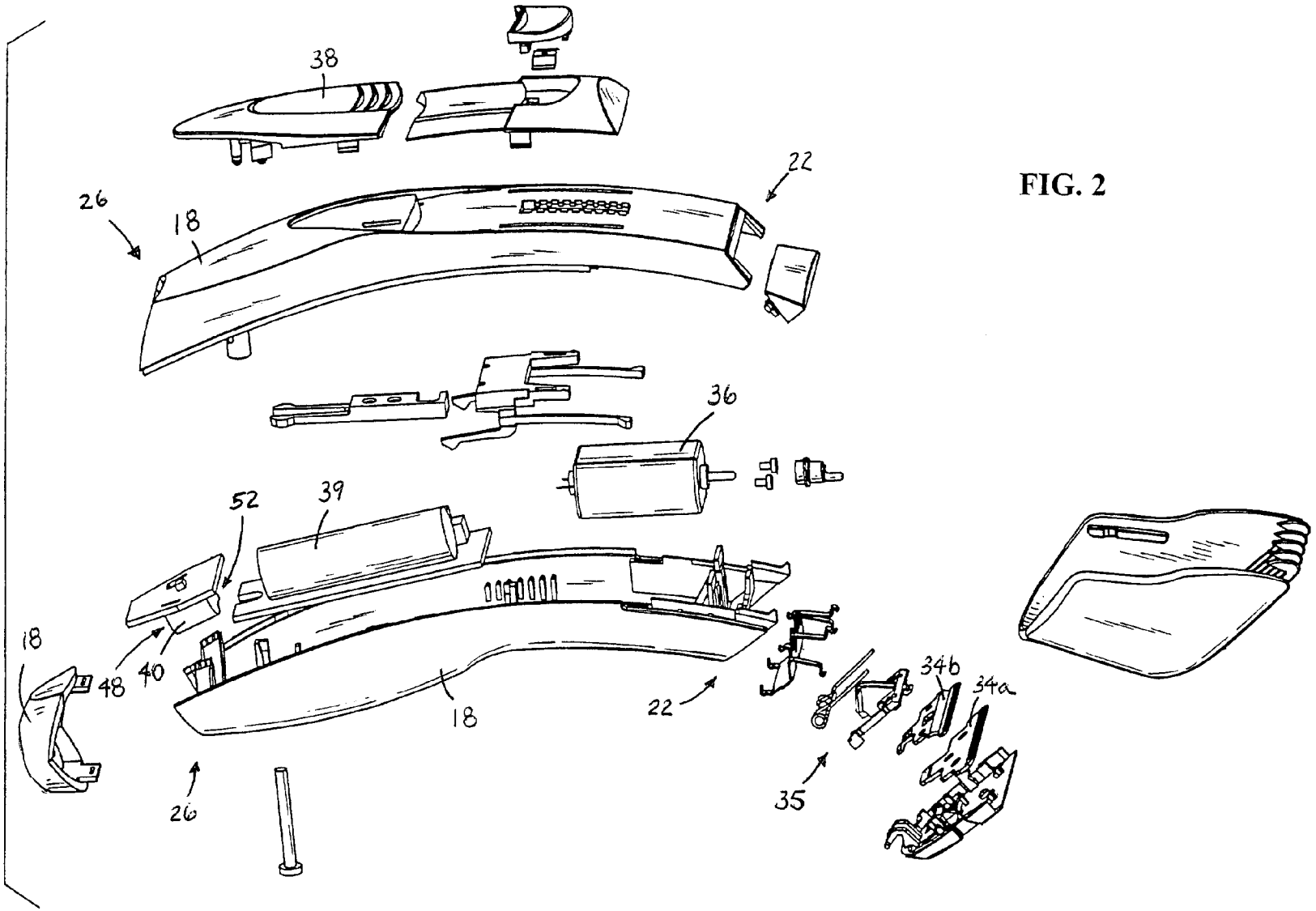
FIG. 2 is an exploded view of the electrical device shown in FIG. 1.
Figure 3:
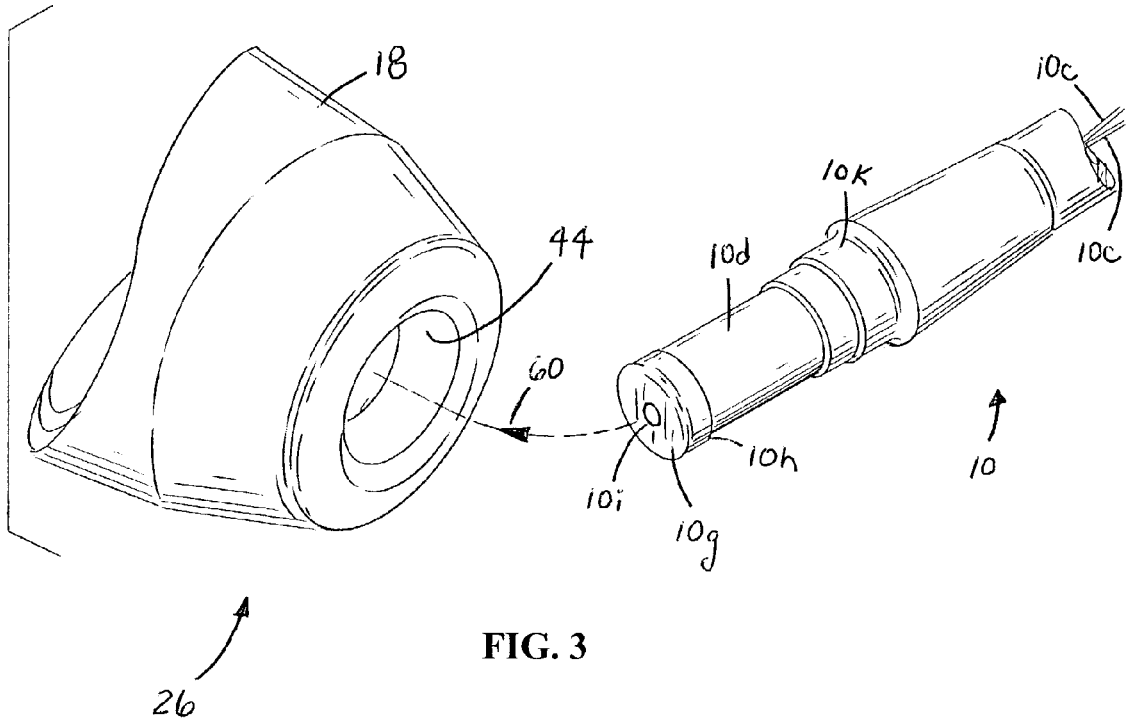
FIG. 3 is a perspective view of the electrical device shown in FIG. 1 illustrating the power cord detached from the housing.

As shown in FIGS. 1 and 2, the hair trimmer 14 includes a hollow, elongated body 18. The body 18 includes a cutting end 22 and a plug end 26. When assembled, the body 18 defines an inner cavity 30 (see FIGS. 5 and 6). A blade set 34 supported on the cutting end 22 includes a fixed blade 34*a* and a reciprocating blade 34*b* biased against and moveable with respect to the fixed blade 34*a* by a drive mechanism 35. An electric motor 36 or actuator is mounted in the inner cavity 30 and is drivingly connected to the blade set 34 by the drive mechanism 35. The electric motor 36 effects reciprocation of the reciprocating blade 34*b* with respect to the fixed blade 34*a* in response to actuation of the electric motor 36. As the hair trimmer 14 is guided through a person's hair, the reciprocating motion of the blade set 34 cuts the person's hair.

A user actuates the electric motor 36 using a power switch 38 provided on the body 18. The switch 38 is configured to interrupt the flow of direct current voltage from a power supply to the electric motor 36. In one embodiment, the direct current voltage is supplied to the electric motor 36 from a direct current power source via the power cord 10 when the power cord is operatively coupled to the hair trimmer 14 (see FIGS. 1 and 6). Various types of direct current power supplies (e.g., an external battery, a voltage transformer electrically coupled to an alternating current power supply) are generally known and, accordingly, not discussed further herein. In another embodiment, the direct current voltage is supplied to the electric motor 36 via a rechargeable battery 39 located in the inner cavity 30. In yet other embodiments, the direct current voltage may be cooperatively supplied to the electric motor 36 via the power cord 10 and the rechargeable battery 39. The power cord 10 may be utilized to supply direct current voltage to recharge the battery 39 during and/or after use of the hair trimmer 14. Hair trimmers powered by direct current voltage are generally known in the art and, accordingly, are not discussed further herein.

Figure 5:
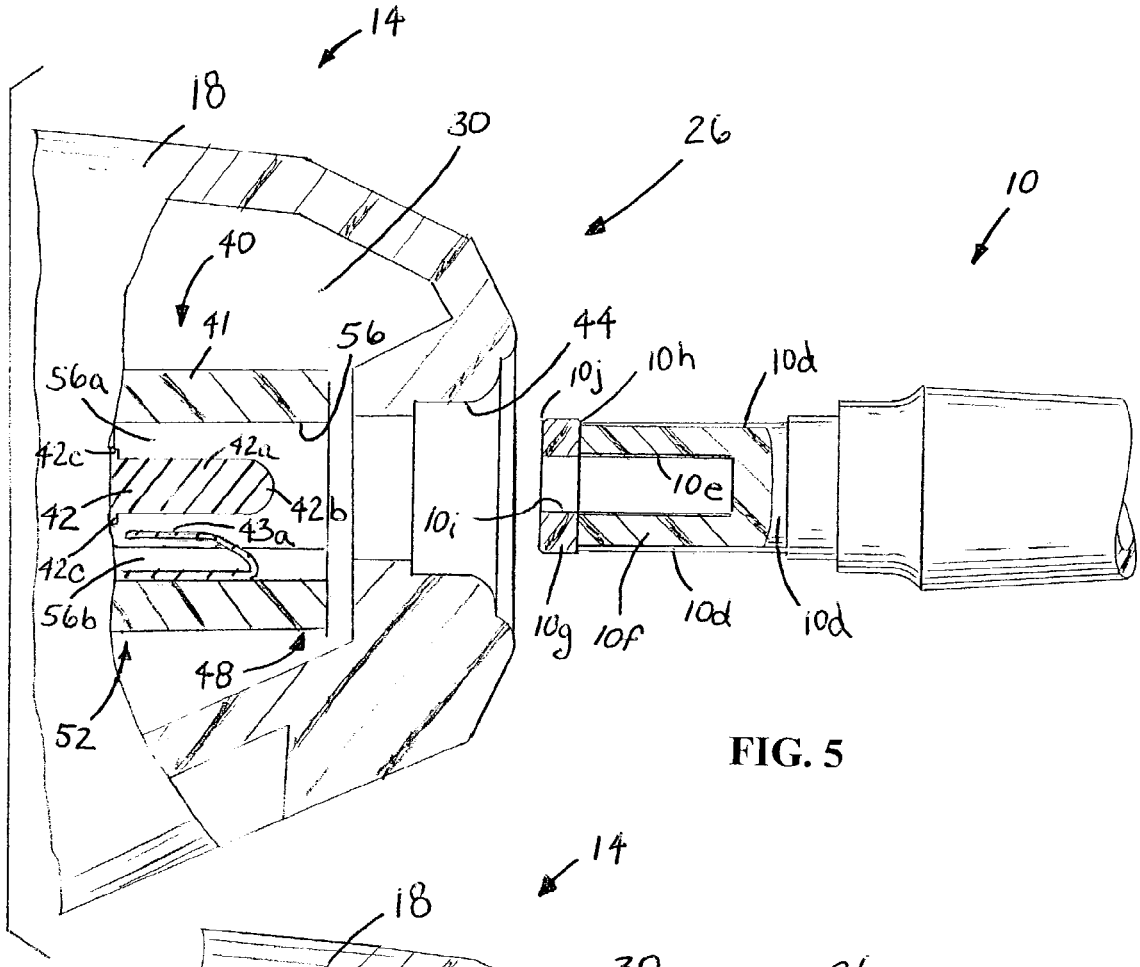
FIG. 5 is a sectional view of the electrical device shown in FIG. 1 illustrating the power cord detached from the housing.
Figure 6:
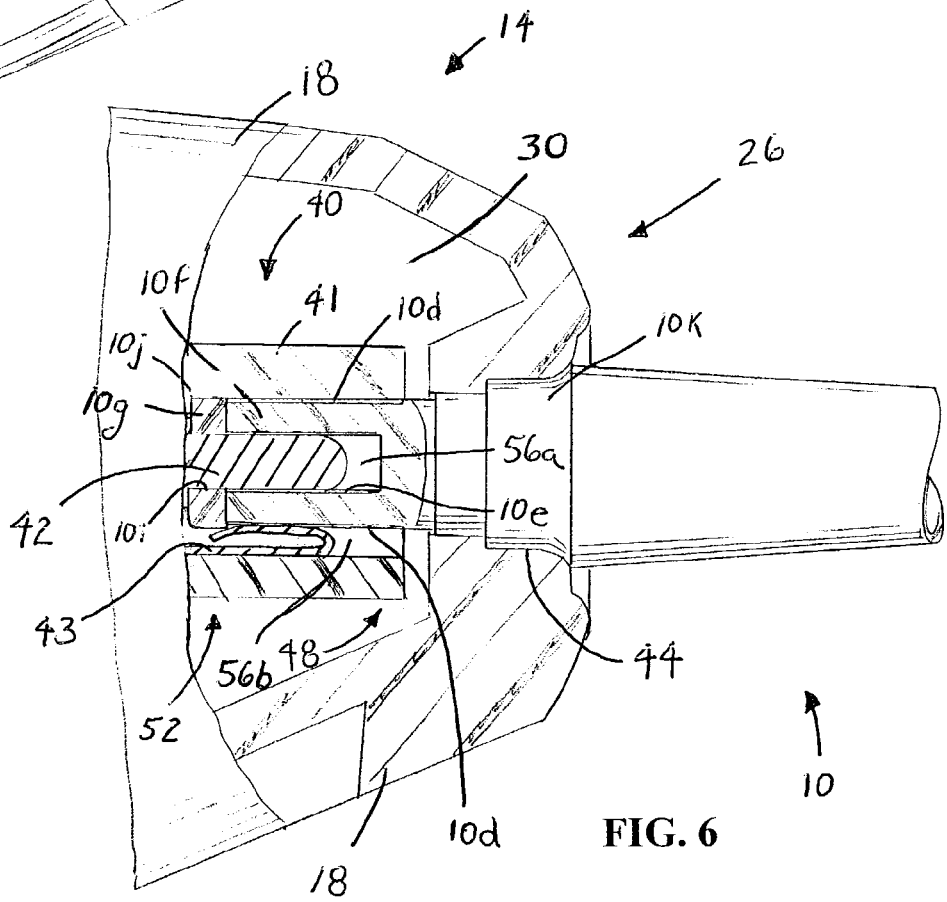
FIG. 6 is a sectional view of the electrical device shown in FIG. 1 illustrating the power cord operatively coupled to the housing.

Referring to FIGS. 5 and 6, an electrical connector or receptacle 40 is mounted in the inner cavity 30 adjacent an aperture 44 defined in the housing 18. The receptacle 40 includes a body portion 41, a male terminal 42, and a detent terminal 43. The body portion 41 includes a first end portion 48, a second end portion 52, and a recess portion 56. The first end portion 48 is located adjacent the aperture 44. The recess portion 56 extends from the first end portion 48 towards the second end portion 52. In one embodiment, the recess portion 56 includes a generally cylindrical portion 56*a* and a detent portion 56*b* that intersects the generally cylindrical portion 56*a*. The male terminal 42 includes a generally cylindrical contact surface 42*a*, a rounded end portion 42*b*, and a stop portion 42*c*. In the illustrated embodiment, the male terminal 42 is centered in the generally cylindrical portion 56*a* of the recess portion 56. The detent terminal 43 includes a deflectable contact surface 43*a*. In the illustrated embodiment, the detent terminal 43 is located in the detent portion 56*b* of the recess portion 56. The detent portion 56*b* provides a recess into which the detent terminal 43 can nest when deflected by the power cord 10 when inserted into the receptacle 40, as more fully discussed below. The male terminal 42 and the detent terminal 43 each includes a contact that extends through the body portion 41 for electrical connection to an electrical component (e.g., the electric motor 36, the rechargeable battery 39, etc.) mounted in the inner cavity 30.

Figure 4:
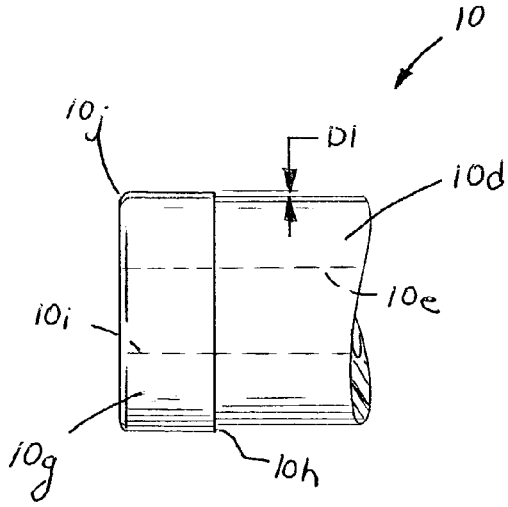
FIG. 4 is a partial side view of the power cord shown in FIG. 1.

Referring to FIG. 1, the power cord 10 includes a plug portion 10*a* and a cord portion 10*b*. The cord portion 10*b* includes two electrical conduits 10*c* that are electrically coupled to a direct current power source. As best seen in FIGS. 5 and 6, the plug portion 10*a* includes an outer terminal 10*d*, a female terminal 10*e*, and an insulator portion 10*f*. The outer terminal 10*d* is electrically coupled to an electrical conduit 10*c* (see FIG. 1). The illustrated outer terminal 10*d* includes a cylindrical contact surface. The female terminal 10*e* is electrically coupled to another electrical conduit 10*c*. The illustrated female terminal 10*e* includes a cylindrical contact surface located radially inward from the outer terminal 10*d*. The insulator portion 10*f* is formed of a electrically nonconductive material. In one embodiment, the insulator portion 10*f* is formed of plastic. In another embodiment, the insulator portion 10*f* is formed of nylon. Use of nylon for the insulator portion 10*f* may provide enhanced abrasion resistance when compared to insulator portions formed of other types of nonconductive material. The insulator portion 10*f* electrically insulates the outer terminal 10*d* from the female terminal 10*e*. The insulator portion 10*f* includes a tip portion 10*g*. The tip portion 10*g* extends axially beyond the outer terminal 10*d* in a direction away from the cord portion 10*b*. As best shown in FIG. 4, the tip portion 10*g* is radially larger than the outer terminal 10*d* by a distance D1 such that the tip portion 10*g* includes a shoulder 10*h* extending radially outward from the outer terminal 10*d*. In one embodiment, the distance D1 is approximately 0.0055 inches. In other embodiments, the distance D1 may be larger or smaller. The tip portion 10*g* also includes an aperture 10*i* that allows for communication with the female terminal 10*e*. In the illustrated embodiment, the tip portion 10*g* includes a chamfered portion 10*j*. In some embodiments, the power cord 10 may also include an over-mold 10*k* (FIG. 3) that at least partially covers the plug and cord portions 10*a* and 10*b*, respectively. In one embodiment, the over-mold 10*k* is formed of vinyl and is sized to correspond to the portion of the housing 18 that defines the aperture 44. Such sizing seals the receptacle 40 from contaminants when the power cord 10 is operatively received in the receptacle 40.

The power cord 10 is configured to provide direct current voltage to the electrical component when the power cord 10 is operatively received in or coupled to the receptacle 40 of the hair trimmer 14. The power cord 10 is illustrated operatively coupled to the receptacle 40 in FIGS. 1 and 6. In the illustrated embodiment, the power cord 10 is allowed to rotate in the receptacle 40 during operation. To operatively couple the power cord 10 to the receptacle 40, the power cord 10 is moved axially toward the aperture 44 as indicated by the arrow 60 shown in FIG. 3. At least a portion of the power cord 10 is inserted through the aperture 44 to operatively couple the power cord 10 to the receptacle 40 (see FIG. 6). The chamfered portion 10*j* of the tip portion 10*g* and the rounded end portion 42*b* of the male terminal 42 are configured to ease movement of the power cord 10 toward the operatively coupled position.

As the tip portion 10*g* is inserted into the receptacle 40, the tip portion 10*g* causes the detent terminal 43 to deflect in a direction away from the male terminal 42. The detent terminal 43 is deflected to a maximum deflected position when the tip portion 10*g* is located in approximately the middle of the contact surface 42*a* of the male terminal 42. As the tip portion 10*g* reaches the stop portion 42*c* of the male terminal 42, the detent terminal 43 springs slightly back towards the male terminal 42 and the power cord 10 is operatively coupled to the receptacle 40.

When the power cord 10 is operatively coupled to the receptacle 40, the outer terminal 10*d* is electrically coupled to the detent terminal 43, the female terminal 10*e* is electrically coupled to the male terminal 42, and the detent terminal 43 is biased against the outer terminal 10*d* and the shoulder 10*h* of the tip portion 10*g* so the shoulder portion 10*h* provides axial resistance against the removal of the power cord 10 from the receptacle 40. As shown in FIG. 6, in order to remove the tip portion 10*g* from the receptacle 40, the detent terminal 43 must be deflected in a direction away from the male terminal 43. The axial resistance provided by the shoulder portion 10*h* increases the force necessary to remove the power cord 10 from the receptacle 40, and thus decreases the likelihood of the power cord 10 being inadvertently detached from the receptacle 40 during operation of the hair trimmer 14.

What is claimed is:

1. A hand-held electrical device comprising:

a housing configured to be hand-held during operation of the hand-held electrical device, the housing defining an aperture;

an electrical component positioned in the housing;

a receptacle electrically coupled to the electrical component, the receptacle having a body portion including a first end portion located adjacent the aperture, a second end portion, and a recess portion extending from the first end portion towards the second end portion, a male terminal having a male terminal portion located in the recess and extending in a direction from the second end portion toward the first end portion, and a detent terminal having a detent terminal portion located in the recess; and a power cord configured to provide direct current voltage to the electrical component when the power cord is operatively received in the receptacle, the power cord having a cord portion including first and second electrical conduits and a plug portion, the plug portion comprising:

a generally cylindrical outer terminal electrically coupled to the first electrical conduit and including a contact surface that defines a first diameter of the plug portion;

a female terminal electrically coupled to the second electrical conduit and located radially inward of the outer terminal; and an insulator portion that electrically insulates the outer terminal from the female terminal, the insulator portion including a tip portion that extends axially beyond the outer terminal in a direction away from the cord portion, the tip portion defining a second diameter of the plug portion, the second diameter being larger than the first diameter, the tip portion including a shoulder extending radially outward from the outer terminal, wherein when the plug portion is operatively received in the receptacle, the male terminal extends into and electrically contacts the female terminal, and the detent terminal is biased against and electrically contacts the outer terminal, and the detent terminal is biased against the shoulder such that engagement of the detent terminal by the shoulder provides axial resistance against the removal of the plug portion from the receptacle.

2. A hand-held electrical device as claimed in claim 1, wherein the outer terminal is rotatable with respect to the detent terminal when the power cord is operatively received in the receptacle.

3. A hand-held electrical device as claimed in claim 1, wherein the tip portion includes a generally cylindrical tip portion.

4. A hand-held electrical device as claimed in claim 1, wherein the tip portion includes a chamfered portion configured to ease insertion of the tip portion into the receptacle.

5. A hand-held electrical device as claimed in claim 1, wherein the housing is formed as a hair trimmer housing.

6. A hand-held electrical device as claimed in claim 1, wherein the insulator portion is formed of plastic.

7. A hand-held electrical device as claimed in claim 1, wherein the insulator portion is formed of nylon.

8. A hand-held electrical device as claimed in claim 1, wherein at least a portion of the power cord is inserted through the aperture to operatively couple the power cord to the receptacle.

9. A hand-held electrical device as claimed in claim 1, wherein the recess includes a generally cylindrical portion defining a third diameter and a detent portion intersecting the generally cylindrical portion, and wherein the third diameter is substantially equal to the second diameter.

10. A hand-held electrical device as claimed in claim 1, wherein the tip portion is configured to deflect the detent terminal from a first position to a second position and allow the detent terminal to return to a third position during insertion of the tip portion into the receptacle, and wherein the third position is between the first position and the second position so the shoulder provides axial resistance against the removal of the power cord from the receptacle when the power cord is operatively received in the receptacle.

11. A hand-held electrical device as claimed in claim 1, wherein the power cord further includes a vinyl over-mold portion that covers a portion of the plug portion and a portion of the cord portion.

12. A hand-held electrical device as claimed in claim 1, further comprising a direct current motor.

13. A hand-held electrical device as claimed in claim 1, further comprising a rechargeable battery.

14. A hand-held electrical device comprising:

a housing configured to be hand-held during operation of the hand-held electrical device, the housing defining an aperture;

a direct current motor positioned in the housing;

a receptacle electrically coupled to the direct current motor, the receptacle having a body portion including a first end portion located adjacent the aperture, a second end portion, and a recess portion extending from the first end portion towards the second end portion, the recess portion having a generally cylindrical portion defining a receptacle diameter and a detent portion intersecting the generally cylindrical portion, a male terminal having a male terminal portion substantially centered in the generally cylindrical portion and extending in a direction from the second end portion toward the first end portion, and a detent terminal having a detent terminal portion located in the detent portion; and a power cord configured to provide direct current voltage to the direct current motor when a portion of the power cord is inserted through the aperture to operatively couple the power cord to the receptacle, the power cord having a cord portion including first and second electrical conduits and a plug portion, the plug portion including a generally cylindrical outer terminal electrically coupled to the first electrical conduit and having a contact surface that defines an outer terminal diameter, a female terminal electrically coupled to the second electrical conduit and located radially inward of the outer terminal, and an insulator portion formed of nylon that electrically insulates the outer terminal from the female terminal, the insulator portion including a generally cylindrical tip portion that extends axially beyond the outer terminal in a direction away from the cord portion, the tip portion defining a tip portion diameter, the tip portion diameter being larger than the outer terminal diameter and substantially equal to the receptacle diameter such that when the power cord is operatively coupled to the receptacle the tip portion provides axial resistance against the removal of the power cord from the receptacle, wherein when the power cord is operative coupled to the receptacle, the male terminal extends into and electrically contacts the female terminal, and the detent terminal is biased against and electrically contacts the outer terminal, and the detent terminal is biased against the tip portion.

15. A hand-held electrical device as claimed in claim 14, wherein when the power cord is operatively coupled to the receptacle, the outer terminal is rotatable with respect to the detent terminal.

16. A hair trimmer comprising:

a housing configured to be hand-held during operation of the hair trimmer, the housing having a cutting end and a plug end and defining an aperture in the plug end;

a blade set mounted adjacent the cutting end;

a direct current motor positioned in the housing and drivingly connected to the blade set;

a receptacle electrically coupled to the direct current motor, the receptacle having a body portion including a first end portion located adjacent the aperture, a second end portion, and a recess portion extending from the first end portion towards the second end portion, the recess portion having a generally cylindrical portion defining a receptacle diameter and a detent portion intersecting the generally cylindrical portion, a male terminal having a male terminal portion substantially centered in the generally cylindrical portion and extending in a direction from the second end portion toward the first end portion, and a detent terminal having a detent terminal portion located in the detent portion; and a power cord configured to provide direct current voltage to the direct current motor when a portion of the power cord is inserted through the aperture to operatively couple the power cord to the receptacle, the power cord having a cord portion including first and second electrical conduits and a plug portion, the plug portion including a generally cylindrical outer terminal electrically coupled to the first electrical conduit and including a contact surface that defines an outer terminal diameter, a female terminal electrically coupled to the second electrical conduit and located radially inward of the outer terminal, and an insulator portion formed of nylon that electrically insulates the outer terminal from the female terminal, the insulator portion including a generally cylindrical tip portion that extends axially beyond the outer terminal in a direction away from the cord portion, the tip portion defining a tip portion diameter, the tip portion diameter being larger than the outer terminal diameter and substantially equal to the receptacle diameter such that when the power cord is operatively coupled to the receptacle the tip portion provides axial resistance against the removal of the power cord from the receptacle, wherein when the power cord is operative coupled to the receptacle, the male terminal extends into and electrically contacts the female terminal, and the detent terminal is biased against and electrically contacts the outer terminal, and the detent terminal is biased against the tip portion.

17. A hair trimmer as claimed in claim 16, wherein when the power cord is operatively coupled to the receptacle, the outer terminal is rotatable with respect to the detent terminal.

* * * * *